United States Patent [19]

Muhsil et al.

[11] 4,251,925

[45] Feb. 24, 1981

[54] APPARATUS FOR DRYING TOBACCO

[75] Inventors: Wilfried Muhsil, Hamburg; Gerhard Graalmann, Wohltorf, both of Fed. Rep. of Germany

[73] Assignee: Hauni-Werke Körber & Co. KG, Hamburg, Fed. Rep. of Germany

[21] Appl. No.: 906,753

[22] Filed: May 17, 1978

[30] Foreign Application Priority Data

May 27, 1977 [DE] Fed. Rep. of Germany ..... 2724037

[51] Int. Cl.[3] ..... F26B 21/10

[52] U.S. Cl. ..... 34/48; 34/212; 34/216; 34/135

[58] Field of Search ..... 34/46, 48, 50, 212, 34/216, 217; 131/135, 136, 138, 140

[56] References Cited

U.S. PATENT DOCUMENTS

| | | | |
|---|---|---|---|
| 3,259,995 | 7/1966 | Powischill | 34/31 |
| 3,372,488 | 3/1968 | Koch et al. | 34/48 |
| 3,482,162 | 12/1969 | Wochnowski | 131/136 |
| 3,556,111 | 1/1971 | Wochnowski | 131/140 R |
| 3,799,176 | 3/1974 | Wochnowski | 131/140 |
| 3,877,469 | 4/1975 | Wochnowski et al. | 131/136 |
| 3,905,123 | 9/1975 | Fowler et al. | 131/135 |
| 4,004,594 | 1/1977 | Wochnowski et al. | 131/135 |
| 4,143,471 | 3/1979 | Wochnowski et al. | 34/28 |

*Primary Examiner*—Larry I. Schwartz

*Attorney, Agent, or Firm*—Peter K. Kontler

[57] ABSTRACT

Apparatus wherein tobacco is dried in several successive units each of which contacts a continuous stream of tobacco with hot air. The moisture content of tobacco is measured between a preceding unit and the next-following unit, and the temperature of hot air which is supplied by the next-following unit is respectively increased and reduced when the monitored moisture content of tobacco respectively rises and decreases. The temperature of air which is admitted by the preceding unit is maintained at a constant value. The temperature of air which is supplied by the next-following unit is further influenced, when necessary, in dependency on measurement of such temperature and in dependency on differences between the final moisture content of tobacco and a preselected optimum moisture content. The detector which monitors the moisture content between the preceding and next-following units is built directly into the conveyor which transports the tobacco stream through the drying units.

10 Claims, 4 Drawing Figures

APPARATUS FOR DRYING TOBACCO

BACKGROUND OF THE INVENTION

The present invention relates to apparatus for conditioning fibrous materials, and more particularly to apparatus for drying tobacco. Still more particularly, the invention relates to improvements in apparatus for reducing the moisture content of successive increments of a continuous tobacco stream.

It is already known to reduce the moisture content of tobacco in several stages, namely, during transport of a continuous tobacco stream through successive drying units in each of which the particles of tobacco are contacted by a hot fluid medium. Tobacco which is heated in such apparatus may consist of shreds (comminuted tobacco leaf laminae), ribs or particles which are converted into the fillers of cigars or cigarillos. The drying action must be predictable with a high degree of accuracy because, in the manufacture of cigarettes and similar rod-shaped smokers' products, the deviation of moisture content of tobacco from an optimum moisture content cannot exceed a fraction of one percent. Each and every deviation of moisture content from an optimum moisture content exerts a highly undesirable influence upon the machinery in which a continuous rod-like filler of tobacco is draped into a web of cigarette paper or the like as well as on the quality of the ultimate product.

U.S. Pat. No. 3,259,995 to Powischill discloses a method and apparatus for drying tobacco in several stages. The temperature of the fluid which contacts tobacco in the first drying unit is ascertained for the purpose of adjusting the temperature of fluid in the second unit when the monitored temperature deviates from a desired value. A drawback of such apparatus is that the temperature of fluid in the first unit is not a reliable indicator of the moisture content of tobacco which advances toward the second unit. Therefore, the final moisture content often deviates from the desired final moisture content. Furthermore, the patented apparatus is rather complex in spite of the fact that it cannot establish predictable conditions for drying in the first unit.

OBJECTS AND SUMMARY OF THE INVENTION

An object of the invention is to provide an apparatus which can invariably, or practically invariably, insure that each and every increment of tobacco which issues therefrom has a predetermined final moisture content.

Another object of the invention is to provide an apparatus which can automatically carry out all necessary adjustments when the moisture content of tobacco therein is such that the final moisture content of tobacco would be likely to deviate from the optimum final moisture content.

A further object of the invention is to provide an apparatus which can dry tobacco in a predictable way even if the initial moisture content of tobacco fluctuates within a rather wide range.

An additional object of the invention is to provide an apparatus which can condition large quantities of tobacco per unit of time in a small area and with a minimum of supervision.

The apparatus which embodies the present invention comprises a vibratory foraminous conveyor or analogous means for transporting a continuous stream of tobacco particles in a predetermined direction along a predetermined path, a plurality of drying units including first and second drying units which are respectively adjacent to first and second portions of the tobacco path and each of which includes means for contacting tobacco with a hot drying fluid, the second unit further including adjustable means for regulating the temperature of fluid in the second portion of the path (such regulating means may include means for mixing heated air with cool air), means for directly monitoring the moisture content of tobacco between the first and second units and for generating signals whose characteristics vary in accordance with variations of moisture content of tobacco between the first and second units, and means for adjusting the regulating means as a function of variations of the characteristics of signals which are generated by the monitoring means so as to respectively increase and reduce the temperature of fluid which contacts tobacco in the second portion of the path when the monitored moisture content respectively increases and decreases.

The transporting means preferably cooperates with the fluid supplying means of the drying units in such a way that the particles of tobacco are caused to float in a body of rising fluid at the upper side of the transporting means. This insures that each and every particle of tobacco is contacted, from all sides, by the fluid medium in each portion of the path. Intensive drying of tobacco renders it possible to reduce the dimensions of the apparatus without affecting the predictability of the demoisturizing action. Moreover, such mode of contacting tobacco with the hot fluid insures uniform drying of successive increments of the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4:
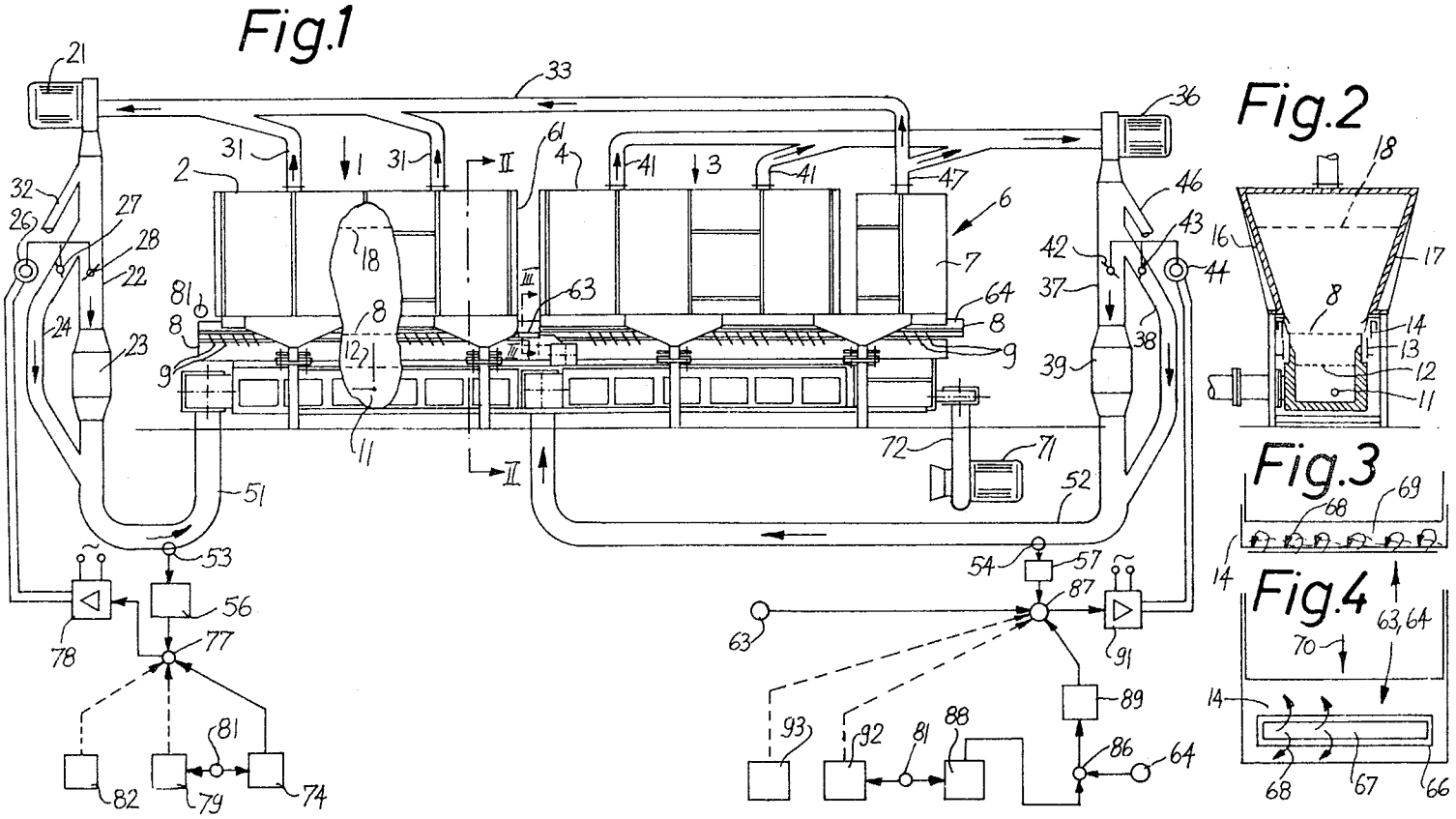
FIG. 1 is a schematic partly elevational and partly longitudinal vertical sectional view of an apparatus with two drying units which embodies the invention.
FIG. 2 is a transverse vertical sectional view as seen in the direction of arrows from the line II—II of FIG. 1.
FIG. 3 is a schematic fragmentary transverse vertical sectional view as seen in the direction of arrows from the line III—III of FIG. 1.
FIG. 4 is a plan view of the structure which is shown in FIG. 3.

The apparatus of FIGS. 1 and 2 comprises a first heating or drying unit 1 and a second heating or drying unit 3. The first drying unit 1 comprises a dryer 2 wherein the particles 69 of tobacco are relieved of moisture while floating in currents of ascending hot drying fluid. The second drying unit 3 comprises a second dryer 4 wherein the particles of tobacco are relieved of moisture in the same way as in the dryer 2. The drying unit 3 is followed by a further treating unit 6 wherein the particles of tobacco are cooled by a device 7 wherein ascending currents of a fluid whose temperature is lower than the temperature of particles issuing from the unit 3 not only cool the particles but also cause them to float during travel through the unit 6.

The exact nature of the dryers 2, 4 and cooling device 7 forms no part of the invention. Reference may be had to commonly owned U.S. Pat. Nos. 3,799,176 and 3,877,469.

The means for transporting a continuous tobacco stream through the dryers 2, 4 and the cooling device 7 comprises a vibratory conveyor 8 which is mounted on pivotable arms 9 and is agitated by a suitable motor through the medium of an eccentric in a manner as disclosed in the aforementioned patents. The conveyor 8 is permeable to fluids so that it allows hot and cool fluids to pass therethrough and to agitate and intimately contact the particles of the tobacco stream which are fed onto and advance along the upper side of the conveyor 8. The means for contacting tobacco with a hot fluid (e.g., air) in that portion of the tobacco path which is adjacent to the drying unit 1 comprises a chamber 11 below a foraminous screen 12 serving to uniformize the pressure of air between its upper side and the underside of the conveyor 8. The conveyor 8 comprises a lower portion 13 (see particularly FIG. 2), a trough 14 and an upper portion having divergent side walls 16, 17 flanking a foraminous screen 18 which prevents particles of tobacco from entering air evacuating pipes 31. The vibratory movements of the conveyor 8 are synchronized with the speed of ascending currents of hot air (such speed decreases while the currents rise in the space between the upwardly diverging side walls 16 and 17) in such a way that the particles of tobacco float in the space immediately above the upper side of the cconveyor 8 and are intimately contacted by hot air from all sides.

The channel 11 receives air from the outlet of a blower 21 which admits air into a pipe 22 containing a heating device 23. Some air which issues from the blower 21 bypasses the heating device 23 via pipe 24 and is admitted into heated air that flows in a pipe 51 connecting the outlet of the heating device 23 with the chamber 11. The pipes 22 and 24 respectively contain adjustable valves in the form of flaps 28, 27 (the flap 28 is mounted in that portion of the pipe 22 which is located downstream of the locus where some of the air enters the bypass pipe 24). The positions of the flaps 27, 28 can be adjusted by a reversible electric motor 26 when the latter receives appropriate signals from an amplifier 78. By changing the positions of the flaps 27, 28, the motor 26 regulates the temperature of air in the pipe 51, i.e., the ratio of air which is heated during passage through the heating device 23 to the air which enters the pipe 51 via bypass pipe 24. The aforementioned pipes 31 discharge spent air into a collecting pipe 33 whose outlet is connected to the intake of the blower 21. A further conduit 32 discharges some air which issues from the outlet of the blower 21. Such air is replaced by air which is admitted by the collecting conduit 33. The latter is further connected to the treating unit 6.

The means for admitting heated air to the chamber below that portion of the tobacco path which is adjacent to the heating unit 3 comprises a pipe 52 which receives air from the outlet of a second blower 36. The blower 36 admits air into a pipe 37 which contains a flap 42 and discharges air into a heating device 39 which, in turn, admits heated air into the pipe 52. A bypass pipe 38 contains a flap 43. The flaps 42, 43 are adjustable by a reversible electric motor 44 which receives signals from an amplifier 91. The intake of the blower 36 draws air from the evacuating pipes 41 of the drying unit 3 and also from the treating unit 6. A pipe 46 for spent air receives some air which is discharged by the blower 36. The reference character 47 denotes a further pipe which receives air from the treating unit 6 and admits such air into the intake of the blower 36.

The parts 42–44 constitute and adjustable regulating device for the temperature of hot air which contacts the particles of tobacco in the dryer 4.

The pipes 51 and 52 respectively contain detectors 53 and 54 which monitor the temperature of heated air streams and transmit appropriate signals to transmitters 56 and 57. The outputs of the transmitters 56, 57 respectively transmit electric signals to signal comparing stages 77 and 87. The detectors 53 and 54 are heat-sensitive semiconductors of known design.

The drying units 1 and 3 are separated by a gap 61. A first moisture detector 63 is installed in the gap 61 to monitor the moisture content of the tobacco stream which advances from the unit 1 into the unit 3, and a second moisture detector 64 monitors the moisture content of tobacco downstream of the cooling device 7.

As shown in FIGS. 3 and 4, the moisture detectors 63 and 64 are immediately adjacent to tobacco in the trough-shaped portion 14 of the conveyor 8. Each of these detectors comprises an insulating plate 66 which is mounted in the bottom panel of the trough 13 and an electrode 67 which is recessed into the insulating plate 66. The trough-shaped portion 14 constitutes the second electrode of each of the detectors 63 and 64. The two electrodes form part of a high-frequency oscillator circuit. The arrows 68 denote the field lines of the capacitor which includes the electrodes 14 and 67. Such lines extend into the path of tobacco particles 69 on the conveyor 8. The direction in which the particles of tobacco advance when the conveyor 8 is in motion is indicated by the arrow 70.

The illustrated moisture detectors 63 and 64 can be replaced with other types of moisture detectors, for example, capacitive detectors of the type known as HWK produced by the assignee of the present application. It is further possible to employ infrared moisture detectors, for example, detectors of the type known as SM 2 (produced by Infrared-Engineering Ltd.).

The cooling device 7 comprises a blower 71 whose outlet admits cool atmospheric air into a pipe 72 connected to the chamber below that portion of the conveyor 8 which is adjacent to the treating unit 6. Some air which is admitted via pipe 72 and is heated on contact with tobacco particles 69 in the treating unit 6 is admitted into the pipe 33, and the remaining preheated air is admitted into the pipe 47. Such air replaces those air streams which are discharged via pipes 32 and 46.

The control circuit for the heating unit 1 comprises a source 74 of reference signals which is connected to the aforementioned signal comparing stage 77. The signal at the output of the stage 77 indicates the difference between the actual temperature of hot air in the pipe 51 (detector 53) and the desired temperature (reference signal from 74). Such output signal is transmitted to the amplifier 78 which adjusts the positions of the flaps 27, 28 via motor 26 whenever the intensity or another characteristic of the signal at the output of the transmitter 56 deviates from the same characteristic of the reference signal. Thus, the control circuit insures that the temperature of hot air which is admitted into the chamber 11 remains constant.

The character 79 denotes a second source of reference signals which is activatable by a device 81 (shown three times in FIG. 1) serving to measure the rate of tobacco admission. The source 79 transmits a reference signal to the signal comparing stage 77 instead of the source 74 when the admission of tobacco to the conveyor 8 is interrupted. It will be noted that the tobacco flow monitoring device 81 is connected with the source 79 as well as with the source 74. A third source 82 of reference signals is connected with the signal comparing stage 77 during starting of the apparatus. At such time, the outputs of the sources 74 and 79 are disconnected from the stage 77.

The signal comparing stage 87 receives signals from the transmitter 57 and from the moisture detectors 63, 64. The output of the stage 87 transmits an adjusting signal to the amplifier 91 for the motor 44 when the intensity or another characteristic of the signal from 63 changes, when the intensity of signal transmitted by 64 deviates from the intensity of reference signal supplied by a source 88, or when the sum or another combination of just mentioned signals deviates from that transmitted by the device 57. The part 89 is a PID circuit which is connected between the stage 87 and a further signal comparing stage 86. One input of the stage 86 is directly connected with the source 88 and another input of this stage is connected with the output of the moisture detector 64. The sources 92 and 93 of reference signals are analogous to the sources 79 and 82. The device 81 in the control circuit section for the drying unit 1 is indentical with the similarly numbered part between the sources 88 and 92. The output of the moisture detector 63 is directly connected to the stage 87.

The broken lines indicate that the sources 79, 82, 92 and 93 are active only when the operation of the apparatus is not automatic. As mentioned above, the sources 79 and 92 transmit reference signals when the admission of tobacco particles 69 is interrupted, and the sources 82 and 93 transmit reference signals during acceleration of moving parts of the apparatus to normal operating speed.

The stage 87 and the amplifier 91 adjust the regulating means 42–44 in response to signals from detector 63, 64 and/or 54. The adjustment is such that the temperature of air in the pipe 52 is caused to rise in response to a rise of moisture content of tobacco in the gap 61 and vice versa.

The operation is as follows:

When the left-hand end portion of the conveyor 8 (as viewed in FIG. 1) receives tobacco, the device 81 activates the sources 74 and 88 which transmit reference signals to the signal comparing stages 77 and 86. Successive increments of the continuous tobacco stream on the conveyor 8 advance through the drying unit 1 and the particles of tobacco are caused to float in the currents of hot air which ascend from the chamber 11 and pass through the sieve 12 and the perforations of the conveyor 8. Such hot air is supplied by the pipe 51 which receives hot air from the heating device 23 and cool air from the bypass pipe 24. The speed of air which rises above the conveyor 8 decreases between the divergent side walls 16 and 17; this insures that the ascending currents of air cannot entrain the lighter particles of the tobacco stream. Hot air thereupon passes through the sieve 18 and is conveyed to the intake of the blower 21 via pipes 31 and 33. The outlet of the blower 21 discharges a certain percentage of air into the atmosphere via pipe 32. As mentioned above, the air stream which is admitted via pipe 33 is preheated due to admission of hot air via pipes 31.

The source 74 of reference signals insures that the temperature of hot air in the pipe 51 is at least substantially constant. Thus, when the temperature which is monitored by the detector 53 deviates from the temperature denoted by the reference signal which is transmitted by the source 74, the signal comparing stage 77 transmits a signal to the motor 26 via amplifier 78 whereby the motor changes the ratio of cool air to hot air in the pipe 51 by appropriate adjustment of angular positions of the flaps 27 and 28. The nature of adjustment is such that the flap 27 moves toward its fully open position when the flap 28 moves toward its fully closed position and vice versa.

The moisture detector 63 in the gap 61 measures the moisture content of tobacco which issues from the drying unit 1. Its signal is transmitted to the signal comparing stage 87. Thus, the intensity of such signal influences the signal which the stage 87 transmits to the amplifier 91 for the motor 44. The circuit for the drying unit 3 is dominated by the signal from 63. The detector 64 transmits signals to the stage 86 which compares such signals with the reference signal from 88 and transmits a signal to the stage 87 (via PID circuit 89) when the measured final moisture content of tobacco deviates from the desired final moisture content. The stage 87 further receives signals from the detectors 54 (via transmitter 57) and 63. If the intensity of signal from 57 deviates from the intensity of signals from 63 and 89, the amplifier 91 starts the regulating motor 44 so as to adjust the flaps 42, 43 in a direction to increase or reduce the temperature of hot air in the pipe 52 and hence the drying action of the unit 3. Hot air which leaves the unit 3 is admitted to the blower 36 via pipes 41. Relatively cool air which is admitted to the blower 36 via pipe 47 compensates for air which is discharged into the atmosphere via pipe 46.

The delay with which the circuit for the second drying unit 3 adjusts the temperature of air in the pipe 52 (and hence the final moisture content of tobacco) is very short. This is due to the fact that the signal comparing stage 87 receives signals from the moisture detectors 63 and 64. Thus, the temperature of air in the pipe 52 is changed in immediate response to detection (by 63) that the moisture content of tobacco leaving the first drying unit 1 deviates from the anticipated moisture content (i.e., when the intensity of signal which is transmitted by the detector 63 deviates from the average intensity. This insures that, in most instances, the moisture content of tobacco in the second drying unit 3 is changed to correspond to the desired final moisture content even before the tobacco batch whose moisture content on leaving the unit 1 is unsatisfactory reaches the second moisture detector 64. In other words, the second moisture detector 64 merely constitutes a safety device which normally influences the drying action only in response to long-range deviations of final moisture content from the desired optimum final moisture content.

Tobacco which leaves the second heating unit 3 enters the treating unit 6 and is cooled by air currents which are admitted by the pipe 72. Heated air which issues from the unit 6 is admitted in part to the collecting pipe 33 (i.e., to the intake of the blower 21) and in part to the intake of the blower 36.

An important advantage of the improved apparatus is that the deviations of moisture content from desired moisture content can be detected before the respective portion of the tobacco stream leaves the drying units, and that such deviations can be eliminated before the respective batch reaches the detector 64. This reduces the percentage of tobacco which leaves the apparatus with a moisture content that deviates from the optimum moisture content.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for reducing the moisture content of tobacco, comprising means for transporting a continuous stream of tobacco in a predetermined direction along a predetermined path; a plurality of drying units including discrete first and second units respectively adjacent to first and second portions of said path, each of said units including means for contacting tobacco with a hot drying fluid and said second unit further including adjustable means for regulating the temperature of fluid in said second portion of said path, said units defining a gap which is traversed by said transporting means; means for directly monitoring the moisture content of tobacco in said gap between said first and second units and for generating signals whose characteristics vary in accordance with variations of moisture content; and means for adjusting said regulating means as a function of variations of the characteristics of said signals so as to respectively increase and reduce the temperature of fluid in said second portion of said path when the monitored moisture content of tobacco respectively increases and decreases.

2. Apparatus as defined in claim 1, wherein said transporting means comprises foraminous vibratory conveyor means having an upper side adjacent to the tobacco stream and an underside, said contacting means including means for supplying fluid to the underside of said conveyor means at a rate such that ascending currents of fluid passing through said conveyor means cause the particles of the stream to float above the upper side of said conveyor means.

3. Apparatus as defined in claim 1, wherein said adjusting means further comprises means for generating second signals denoting the difference between the moisture content of tobacco downstream of said second unit, as considered in said direction, and a predetermined moisture content, means for generating third signals denoting the temperature of fluid which is admitted into said second portion of said path, and means for comparing said first mentioned, second and third signals and for generating resultant signals which are transmitted to said regulating means.

4. Apparatus as defined in claim 1, further comprising control means for maintaining the temperature of fluid which is supplied by the contacting means of said first unit at a substantially constant value.

5. Apparatus as defined in claim 4, wherein said control means includes means for monitoring the temperature of fluid which is supplied to said first portion of said path and means for changing the temperature of such fluid when the monitored temperature deviates from a predetermined value.

6. Apparatus as defined in claim 1, further comprising means for cooling tobacco in a further portion of said path downstream of said units.

7. Apparatus as defined in claim 1, wherein said monitoring means includes a moisture detector which is installed directly in said transporting means.

8. Apparatus as defined in claim 1, wherein said regulating means includes means for mixing hot and cool fluids.

9. Apparatus as defined in claim 1, further comprising means for recirculating some of the fluid which has contacted the tobacco stream in at least one of said first and second portions of said path.

10. Apparatus as defined in claim 1, wherein the fluid is air.

* * * * *